US005309148A

United States Patent [19]

Birk

[11] Patent Number: 5,309,148

[45] Date of Patent: May 3, 1994

[54] APPARATUS AND METHOD FOR TESTING SMOKE DETECTOR OPERATION

[76] Inventor: David M. Birk, 8871 Willowwood Way, Jessup, Md. 20794

[21] Appl. No.: 992,731

[22] Filed: Dec. 18, 1992

[51] Int. Cl.[5] ..... G08B 17/10

[52] U.S. Cl. ..... 340/628; 73/1 G; 252/305

[58] Field of Search ..... 340/628; 73/1 G; 252/305, 408.1; 222/4

[56] References Cited

U.S. PATENT DOCUMENTS 3,693,401 9/1972 Purt et al. ..... 340/628 X
4,301,674 11/1981 Haines et al. ..... 73/1 G
5,139,699 8/1992 Cooper et al. ..... 73/1 G X

*Primary Examiner*—Jeffery A. Hofsass
*Attorney, Agent, or Firm*—Morton J. Rosenberg; David I. Klein

[57] ABSTRACT

Both an apparatus and method for testing smoke detector operation is provided. The apparatus and method is used to either standardize conventional smoke detectors, or to test the actuation of an alarm signal for smoke detectors. In one embodiment of the invention, a standard dispenser is used which contains a liquid suspension of substantially uniformly sized latex particulates which are introduced into the smoke detector. The substantially uniformly sized latex particulates enter the smoke detector and simulate combustion product particulates. The uniformly sized latex particulates are used to actuate an alarm signal for a conventional smoke detector to test the smoke detector operation. In this manner, there is provided both a system and a method of testing smoke detectors which does not leave a residue on or in the smoke detectors and advantageously does not effect the operation or operating life of a smoke detector.

19 Claims, 1 Drawing Sheet

APPARATUS AND METHOD FOR TESTING SMOKE DETECTOR OPERATION

BACKGROUND OF THE INVENTION

This invention is directed to an apparatus and method for testing smoke detector operation. In particular, this invention is directed to a system and method for applying simulated smoke particulates to conventional smoke detectors to test the alarm actuation thereof. More in particular, this invention is directed to a system and method whereby a user may control the size and distribution of sizing of particulates being impinged and entering a conventional smoke detector. Additionally, this invention relates to a system and method for testing smoke detector operations where the particulate matter may be used for standardization of testing procedures and standardization of test parameters between various conventional smoke detectors. Further, this invention directs itself to a smoke detection test system which utilizes atomized spray compositions formed of substantially uniformly sized latex particles in liquid suspension. More in particular, this invention pertains to a smoke detection test system utilizing atomized spray compositions having a diameter range between 0.01 μm-1.0 μm with a preferred range between 0.01 μm-0.5 μm. Further, standard aerosol containers containing the substantially uniformly sized latex particulates may be used in construction of the invention, or in the alternative, a manually dischargeable pump action container may be used for insertion of the particulates into the conventional smoke detector systems. Additionally, mixtures of differing diameters may be used simulating the particle distribution diameters of various combustion products. Further, this invention directs itself to the method and apparatus for testing smoke detector operations where the particulate being inserted into the smoke detectors is substantially inert with respect to the environment, as well as the smoke detectors, and does not leave a residue which would hamper future use of the smoke detectors.

Still further, this invention concept pertains to a system and method where simulated particulates may be provided in a sized distribution which closely approximates actual combustion product particulate sizes and distributions.

PRIOR ART

Smoke detection test systems and compositions are known in the prior art. The best prior art known to Applicant includes U.S. Pat. Nos. 4,301,674; 3,693,401; 5,139,699; 5,076,966; 5,057,243; 4,462,244; 4,917,830; 4,004,049; 4,151,233; 3,499,723; 3,729,979; 3,985,868; 5,060,503; 4,990,290; 4,715,985; 4,520,157; D275,183; 3,808,088; and United Kingdom Patent 1,527,003.

U.S. Pat. No. 4,301,674 provides for a test spray to be inserted into a conventional smoke detector and uses a pressurized container filled with a propellant such as isopropyl alcohol and dioctyl phthalate. However, although this mixture is discharged into the atmosphere near the smoke detector being tested and the particles of dioctyl phthalate enter the detector for the purpose of causing an alarm signal, it is noted that at the time of discharge into the atmosphere, only the base mixture is provided. This generates a range of particles associated with combustion products, however, such generates an unnecessarily large number of particles of extraneous sizes which are external the size ranges of combustion products and are comprised of the highly viscous oil-like substance dioctyl phthalate that leaves a disadvantageous residue external and internal to the detector and has a negative effect on the smoke detector's operation and time usage. Further, in addition to decreasing the operation life of such detectors, this system uses isopropyl alcohol which has detrimental and disadvantageous effects on ionization type smoke detectors. Of further significance is the fact that the resulting aerosol spray from this prior art system is highly flammable. The use of dioctyl phthalate, a plasticizer, as part of the propellant degrades the plastics used in conventional smoke detection systems.

In prior art U.S. Pat. No. 3,693,401, there is provided a pressurized container in which a test gas is held under pressure which is released into a sleeve placed over a detector to be tested which contains the test gas. However, this prior art system does not provide for a gas which utilizes a range of particles approximating those of combustion products, as is necessary to the entire concept of the subject invention system and method.

Other types of prior art systems used for testing smoke detectors, such as United Kingdom Patent No. 1,527,003 also use dioctyl phthalate, or other viscous fluids such as glycols, wherein each have some of the same disadvantages as previously described for U.S. Pat. No. 4,301,674.

In some prior art systems such as that shown in U.S. Pat. No. 5,139,699, phthalate esters are used in the propellant mixtures which may have a degrading effect on the plastics used in standard smoke detectors.

None of the prior art systems and methods known to the Applicant permit matching of particular simulated particulates to actual combustion product particulates as is provided in the subject invention concept.

SUMMARY OF THE INVENTION

A smoke detection test system and method is provided for actuating an alarm signal of a conventional smoke detector and includes a standard dispenser containing a liquid suspension which, when actuated, provides an atomized spray of a predetermined composition. The predetermined composition is provided for impinging the conventional smoke detector wherein the atomized spray predetermined composition includes a substantially uniformly sized latex plurality of particles in liquid suspension for passing into the conventional smoke detector.

DESCRIPTION OF THE PREFERRED EMBODIMENTS

Referring now to the invention concept, there is provided a smoke detection test system and method for testing smoke detectors which utilizes the concept of simulating combustion products through the use of substantially uniformly sized latex particulates and mixtures thereof which may simulate particulate distribution sizes of combustion products. Although herein described in particular for smoke detection test systems for testing conventional smoke detectors, it will be understood that the subject system and method applies to many areas of use where simulated combustion product particles are needed such as the area of using the subject system and method as a standardized test smoke for research and development. At the present time, reproducibility of test smokes from burning objects are extremely difficult to achieve and the subject system and method provides a system whereby standardization of smoke detectors and accessories may be provided.

Figure 1:
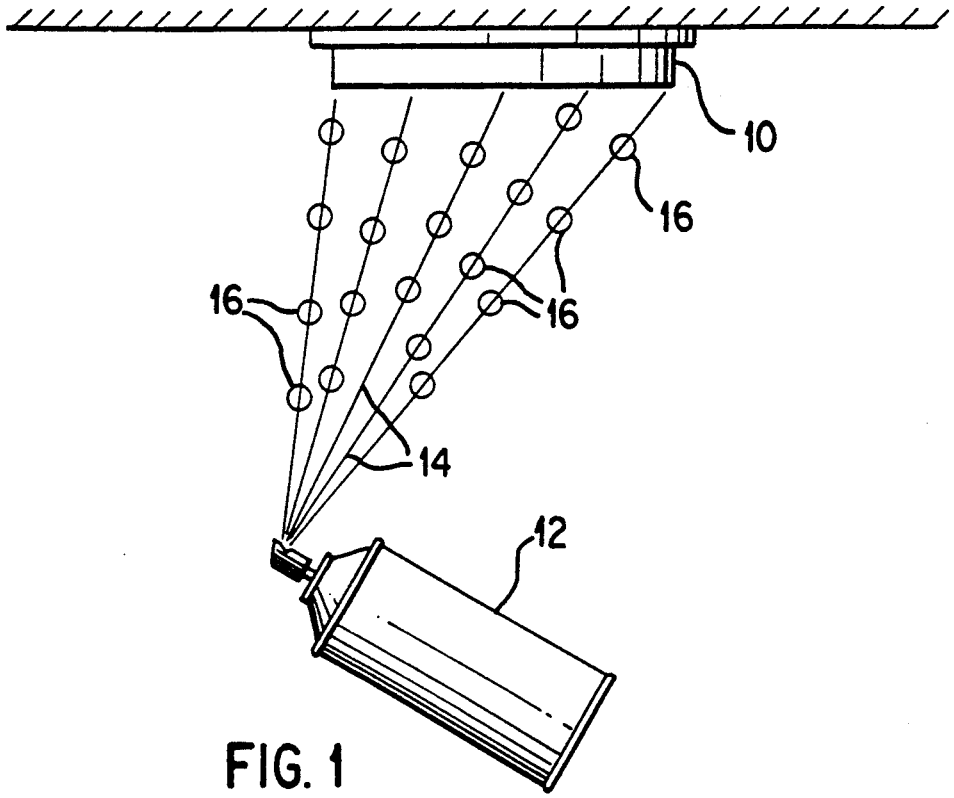
FIG. 1 is an elevational view of the instant smoke detection system applying a spray of substantially equally sized latex particles to a smoke detector; and, FIG. 2 is an elevational view of the instant smoke detection system applying a spray of a mixture of differently sized latex particles to a smoke detector.
Figure 2:
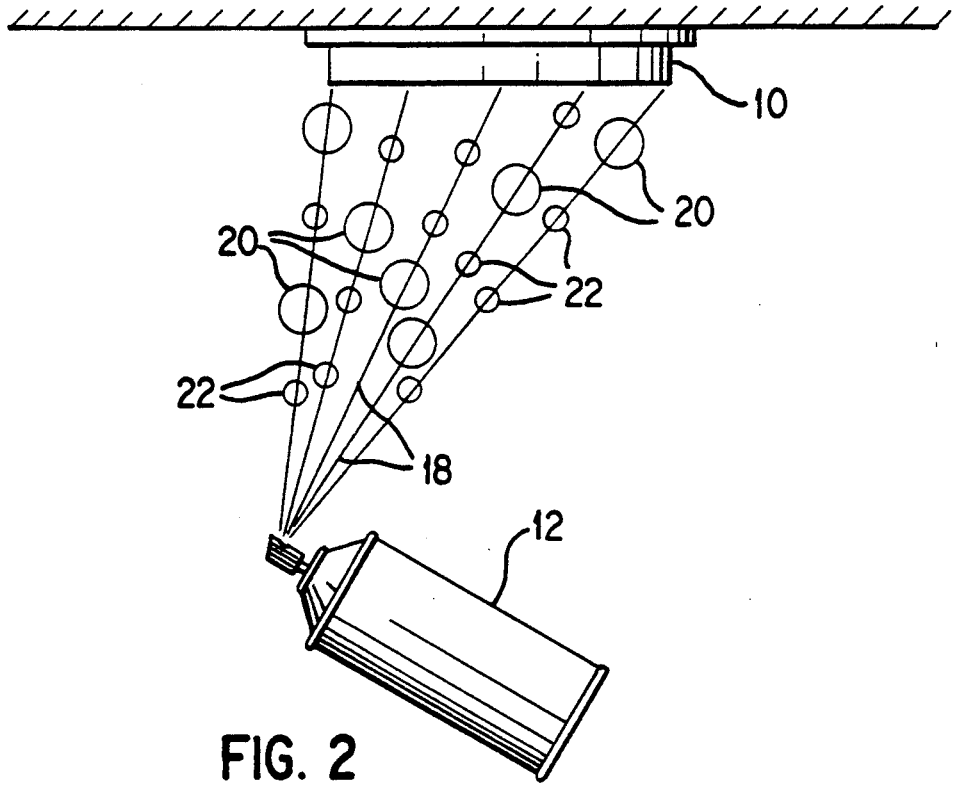

As shown in FIGS. 1 and 2, there is provided a standard smoke detector 10 which either represents a commercially available smoke detector or other system upon which are sprayed simulated combustion particles. Referring to FIG. 1, a commercially available pressurized spray or pump can 12 has been actuated to provide spray 14 consisting of uniformly sized and substantially equally dimensioned particles 16. Spray 14 enters detector 10 and initiates an internal alarm for testing purposes.

It is to be understood that one of the major advantages of using substantially uniformly sized latex particulates is that the user may mix different proportions of differently sized particulates to produce a size distribution which simulates particular size ranges for specific combustion products. Studies have been made concerning combustion product particulate sizes and through use of the subject concept particulate simulation may be accurately produced.

Referring to FIG. 2, commercially available pressurized or pump spray can 12 is activated to provide a spray 18 consisting of a mixture of differently sized latex particles 20 and 22. However, it is to be noted that each set of particles 20 and 22 are substantially uniformly dimensioned. Two sets of sized particles 20 and 22 are shown, however, it is to be understood that additional sets of particle sizes may be used to provide the user with a predetermined size distribution spray 18 dependent upon a particular use.

In general, most conventional smoke detectors are provided to detect the presence of particulate components of combustion products. Responsive to the detection of the smoke combustion products, an audible and/or visual alarm is actuated. Performances of smoke detectors depend on a multiplicity of factors external to the inherent particle size response characteristics. Entry characteristics of a particular smoke detector is extremely important, and of course, reliability of a smoke detector over an extended period of time must be considered. The subject concept is directed to conventional smoke detectors and relies upon the important concept of particle size and concentration, which are generally considered to be the two most important properties effecting detector response. Refractive indices of an aerosol effects the light scattering type detectors and the particle charge may effect the ionization detector whereas the shape of the spray or aerosol effects the two generally used detectors which are the light scattering detector and the ionization detector system, to be generally described in following paragraphs.

Light scattering smoke detectors generally rely upon scattering of light by the smoke particles. An aperture is provided which produces a collimated light beam and an inner surface of a scattering chamber is blackened to minimize reflected light from entering a photocell contained therein. Obviously, with no combustion product particles present, there is no light reaching the photocell. However, as smoke enter the detector system, light is scattered onto the photocell and some type of alarm is sounded or otherwise actuated. In this type of system, the intensity of the scattered light from the combustion product particles depends both on the particle size and shape, as well as the refractive index in combination with the spectral distribution of the light source. As can be understood, where extremely fine and uniformly contoured particulates are used to simulate the smoke detection process, standardization techniques can be employed between various smoke detectors. Thus, it is important to obtain a uniformly sized set of particulates which do not otherwise interfere with the smoke detectors for use as either standardization, or the actual testing of the smoke detectors.

Another type of conventional smoke detector system is called the ionization detector. Basically, this type of detector relies upon the adherence of ions to smoke particles. The ions are produced by the interaction of particular radiation with molecules in the atmosphere. In the absence of smoke particulates, positive ions are displaced toward one electrode while negative ions are displaced in the opposite direction to produce an electrical current. The current is reduced by the presence of smoke combustion particulates due to the capture of the ions by the smoke particulates. An electric field within the detector system is not strong enough to collect the charged smoke particles which generally have a lower electrical mobility than the ions and at some preset minimum current range, an audio and/or visual alarm is actuated. In this type of detector system, performance depends on the geometry and dimensions of the overall ionization chamber, as well as the characteristics of a radioactive source and the voltage. However, of importance, once again, is the size and concentration of the particulates entering the system and whether such capture the ions.

In order to simulate combustion products, it was realized that certain characteristics of potential particulates 16 or 20 and 22 had to be found. In particular, in order to accommodate the sizing, specific simulated smoke particle sizes had to be found which could be reproduced. Additionally, where standardization procedures are necessary, specific repeatable distribution sizes and concentrations of the particulates being used had to be attained. Still further, and in particular, when dealing with light scattering type smoke detectors, particulates 16, 20 and 22 had to be able to be colored to simulate combustion products. Particularly, the contouring of the particulates 16, 20 and 22 was of importance in such trying to have a uniform geometric contour with a spherical shape being a standard model so that such would be reproducible and not damage standard smoke detectors. Non-conductive particles were of importance for ionization type systems, and of course, it was of importance to have inert type particles which could be sprayed in the atmosphere. Additionally, many types of particles agglomerate and thus, could not be controlled to provide the specific smoke detection characteristics necessary. If needed, for particular smoke detectors 10, it was required that the particulates 16, 20 and 22 be electrically charged. All of these properties and characteristics were searched, and most potential solid particulates to be used in the simulation process were found to agglomerate, provide for irregular geometric contours, having a weight or density which was extremely high, and in some cases, were found to have health concerns. Additionally, many particulate compositions had the unwanted property of chemically reacting with the compositions of impinging smoke detector housings.

Applicant has found that a class of particles is useful and provides for the advantages previously described. Such particulates are commonly known as uniform latex particles produced by a number of companies, one of which is Seradyn, Inc. Uniform latex particles have been formed in extremely uniform and small diameter spheres. In general, when such particulates are less than 5 μm in diameter, such are usually prepared by emulsion polymerization, which results in a series of particles having extremely uniform size distributions. In actual tests, the uniformity is measured by the standard deviation or coefficient of variance which generally approximates 1.0%. This is sufficient for the invention concept use in simulation of combustion product particulates for testing smoke detectors.

In general, the simulated combustion products particles are derived from emulsion polymerization of a plurality of polymers which include: polystyrene; polyvinyltoluene; styrene-butadiene; styrene-divinylbenzene; styrene-vinyltoluene; vinyltoluene-tertiary-butylstyrene; polymethylmethacrylate; and, vinyl benzyl chloride. The polystyrene used by the inventor in the simulation had a polymer density approximating 1.0 g/ml with a refractive index approximating 1.6 at room temperature. The styrene-divinylbenzene had a weight ratio of 95.0% styrene to 5.0% divinylbenzene, with the overall combination having a polymer density approximating 1.0 g/ml with a refractive index of approximately 1.6. The styrene-butadiene had a weight ratio of approximately 95.0% styrene to 5.0% butadiene and the vinyltoluene-t-butylstyrene had a weight ratio of 63.0% vinyltoluene to 37% t-butylstyrene with the polymer density essentially remaining approximately 1.0 for all cases and a refractive index approximating 1.6, however, the vinyltoluene-tertiary-butylstyrene refractive index was not available. Both polystyrene and polyvinyltoluene provided polymer densities approximating 1.0 g/ml with refractive indexes of approximately 1.6 at a wavelength of approximately 5890.0 angstroms.

In testing the inventive concept, both light scattering and ionization smoke detection chambers of the conventional variety were used.

Use of the above-referenced uniform latex particles is believed to be the novel and new concept proposed for the testing of conventional smoke detectors, as well as allowing for standardization of simulated combustion product particles. As previously described, substantially uniformly-sized latex particles 16, 20 and 22 are generally produced into uniform small diameter spheres and as used by the inventor, may be particles derived from polystyrene. Such uniform latex particles are commercially available from a diameter of less than 0.1 μm to 5.0 μ. Such may be obtained in water solution and generally 10% solids, although other concentrations are available. A 10% concentration of 0.1 μm polystyrene has approximately $1.83\times10^{14}$ particle per ml. Since such uniform latex particles may be formed in uniform sizes throughout the range of less than 0.1 μm to approximately 5.0 μm, there is the ability to select as well as mix varying sizes and concentrations of the uniform latex particles to arrive at some particular particle size or distribution, as well as concentration of simulated smoke particles within a test aerosol spray without the necessity of having excessive amounts of particles or extraneous particles. As stated, the uniform latex particles are commercially available as water suspensions which may be 10% concentration of the uniform latex particles, but such may be diluted or concentrated, as is necessary. Additionally, the latex particles may be removed from aqueous suspension and resuspended in other liquids or dried. The water base suspension of such particles allows the use in conjunction with water soluble propellants such as dimethyl ether and/or 1-1-difluoroethane. The dimethyl ether and 1-1-difluoroethane may be combusted, however, when mixed with the water-uniform latex particle suspension, the flammability of the resulting test aerosol may be controlled by the user, as is necessary. Dimethyl ether and 1-1 difluoroethane do not contain chlorine atoms and as such do not effect stratospheric ozone depletion.

Testing of the invention concept relating to the use of substantially uniformly sized latex particles for impingement upon smoke detectors to achieve an alarm signal has been undertaken and found to have favorable results. In the basic testing, both conventional ionization smoke detectors, as well as light scattering smoke detectors, were utilized. Aerosol cans 12 using the invention concept were made up which had approximately 98.0% by weight dimethyl ether used as a propellant with an approximate 2.0% by weight combination uniform latex particles and water suspension. Initially, tests were run between uniform latex particle solutions having a mean diameter of 0.06 μm to 1.0 μm. Polystyrene spheres were used which were typically diluted to 0.1% solids. Water contained in the solution did disperse upon discharge providing a substantially invisible test spray for all runs. The typical overall test set-up used 0.1% solids in the 2.0% solution with the remainder of the solution (99.9%) being water. The experiments were repeated using the same concentrations of 1-1-difluoroethane as a propellant with the same results. However, the 1-1-difluoroethane is believed to include the advantage of being a relatively inert chemical which would have less effect on contacting compositions over an extended time duration.

It should be noted that experiments were run between 2.0%-20.0% by weight of solution. For purposes and objectives of this concept when 20% was used, a noticeable moisture residue was found on surfaces which was deemed to be disadvantageous.

For test runs of the light scattering smoke detector and the ionization type smoke detector, it was found that reaction times for an audio alarm were significantly decreased when the polystyrene sphere latex particles had a mean diameter within the range of 0.06 and 0.5 μm. It was not understood why the reaction or initiation time was lowered, however, it is believed that where there are more particles, such would effect the light scattering as well as the ionization to an extent which provides for advantages in the reaction time of the atomized spray discharge.

Additionally, in both cases for the light scattering smoke detectors, as well as the ionization detectors, no visible residue was found and there were no contaminants on the smoke detectors which is generally found with prior art systems. It is believed that this was due to the inert characteristics of the uniform latex particles as herein described and the significantly reduced base mixture residue generated.

Similar results were found when substantially uniformly sized latex particles in aqueous suspension were used which were derived from polymethacrylate polymers through an emulsion polymerization process.

Further tests were initiated where the particulate size diameter of the latex particulates were increased to 1.0 μm. The reaction time seemed to decrease significantly for the particulate range between 0.5 μm–1.0 μm, although such still allowed for usable results. Once again, although it is not known why the reaction times decreased specifically, it is believed that the smaller particle size diameters between the range of 0.06 μm and 0.5 μm allowed for increased light scattering, as well as maximized electrical properties for the ionization type detectors.

Thus, there is provided a smoke detection test system for actuating a standard alarm signal of a conventional smoke detector which includes a dispenser 12 which may be of the standard pump type, or as an aerosol can which contains a liquid suspension, which when actuated, provides an atomized spray 14 or 18 of a predetermined composition which includes substantially uniformly sized latex particulates 16 or 20 and 22 in a liquid suspension, having a preferred mean diameter of the latex particulates within the approximating range of 0.01 μm–0.5 μm.

Further, there is provided an improved method of testing smoke detectors 10 wherein a liquid suspension of substantially uniform sized latex particulates 16 and mixtures 20 and 22 thereof to simulate combustion product sizing is established, and such is applied to a smoke detector 10 for actuating the alarm signal. The step of applying the liquid suspension of substantially uniformly sized latex particles includes the step of spraying the liquid suspension on and into the smoke detectors for simulating combustion products impinging on the smoke detectors. The step of applying the liquid suspension further includes the step of atomizing a liquid or aqueous suspension of the uniformly sized latex particulates, where the latex particulates have a size diameter within the approximate preferred range of 0.01 μm–0.5 μm.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention, as defined in the appended Claims.

What is claimed is:

1. A smoke detection test system for actuating an alarm signal of a conventional smoke detector including a dispenser containing a liquid suspension which when actuated provides an atomized spray of a predetermined composition for impinging said conventional smoke detector, where the improvement comprises:

said atomized spray predetermined composition including substantially uniformly sized latex particulates in liquid suspension and mixtures thereof, said latex particulates being in said liquid suspension prior to said atomized spray being produced.

2. The smoke detection test system as recited in claim 1 wherein said latex particulates have a particulate size diameter within the approximate range of 0.01 μm to 1.0 μm.

3. The smoke detection test system as recited in claim 2 wherein said latex particulates have a particulate size diameter within the approximate range of 0.01 μm to 0.5 μm.

4. The smoke detection test system as recited in claim 1 where said latex particulates are derived from a polymer comprising polystyrene.

5. The smoke detection test system as recited in claim 1 where said latex particulates are derived from at least one polymer selected from the group consisting of polystyrene, polyvinyltoluene, styrene-butadiene, styrene-divinylbenzene, styrene-vinyltoluene, vinyltoluene-tertiary-butylstyrene, polymethylmethacrylate, and vinyl benzyl chloride.

6. The smoke detection test system as recited in claim 1 where said liquid suspension includes an aqueous liquid and latex particulate composition, said latex particulate forming approximately 0.1% by weight of said aqueous liquid.

7. The smoke detection test system as recited in claim 6 wherein said liquid suspension includes a propellant composition, said propellant composition having a weight percentage approximating 98.0% by weight of a total amount of said propellant composition, said latex particulates and said aqueous liquid.

8. The smoke detection test system as recited in claim 7 where said propellant composition consists of a composition from the group of dimethyl ether and 1-1-difluoroethane and mixtures thereof.

9. A smoke detection testing system comprising:

(a) smoke detection means for actuating an alarm signal when combustion products are detected;

(b) means for simulating said combustion products when applied to said smoke detection means thereby actuating said alarm signal in a testing mode of operation, said means for simulating said combustion products including particulate dispensing means containing a plurality of substantially uniformly sized latex particulates and mixtures thereof, said latex particulates being in liquid suspension within said particulate dispensing means.

10. The smoke detection testing system as recited in claim 9 where said dispensing means includes an aerosol can for applying an atomized spray of said substantially uniformly sized latex particulates on said smoke detection means.

11. The smoke detection testing system as recited in claim 10 where said latex particulates have a particulate size diameter within the approximating range of 0.01 μm to 0.5 μm.

12. The smoke detection testing system as recited in claim 9 where said dispensing means includes a manually actuated pump spray can for applying an atomized spray of said substantially uniformly sized latex particulates on said smoke detection means.

13. The smoke detection testing system as recited in claim 12 where said latex particulates have a particulate size diameter within the approximating range of 0.01 μm to 0.5 μm.

14. The smoke detection testing system as recited in claim 9 where said substantially uniform latex particulates are derived from a polymer comprising polystyrene.

15. A method of testing smoke detectors including the steps of:

(a) establishing a liquid suspension of substantially uniformly sized latex particulates; and, (b) applying said liquid suspension of said substantially uniformly sized latex particulates to a smoke detector for actuating an alarm signal, said latex particulates being in said liquid suspension prior to application of said liquid suspension to said smoke detector.

16. The method of testing smoke detectors as recited in claim 15 where the step of applying said liquid suspension includes the steps of spraying said liquid suspension on said smoke detectors for simulating combustion products impinging on said smoke detectors.

17. The method of testing smoke detectors as recited in claim 15 where the step of applying said liquid suspension includes the step of atomizing an aqueous suspension of said latex particulates.

18. The method of testing smoke detectors as recited in claim 15 where the step of establishing a liquid suspension includes the step of providing approximately 0.1% by weight of latex particulates to an aqueous composition.

19. The method of testing smoke detectors as recited in claim 15 where the step of establishing said liquid suspension includes the step of providing said latex particulates having a particulate size diameter within the approximate range of 0.01 μm to 0.5 μm.

* * * * *